US010023435B2

(12) United States Patent
Taylor

(10) Patent No.: US 10,023,435 B2
(45) Date of Patent: Jul. 17, 2018

(54) HOISTING APPARATUS WITH ENCLOSURE AND LIFTING PLATFORM

(71) Applicant: ISCHEBECK TITAN LIMITED, Burton upon Trent, Staffordshire (GB)

(72) Inventor: Mark Taylor, Burton upon Trent (GB)

(73) Assignee: ISCHEBECK TITAN LIMITED, Burton, Upon Trent (GB)

( * ) Notice: Subject to any disclaimer, the term of this patent is extended or adjusted under 35 U.S.C. 154(b) by 42 days.

(21) Appl. No.: 15/179,819

(22) Filed: Jun. 10, 2016

(65) Prior Publication Data

US 2016/0362278 A1 Dec. 15, 2016

(30) Foreign Application Priority Data

Jun. 11, 2015 (GB) ..... 1510188

(51) Int. Cl.

| | |
|---|---|
| ***B66B 9/187*** | (2006.01) |
| ***B66B 11/00*** | (2006.01) |
| ***E04G 3/28*** | (2006.01) |
| ***E04G 21/32*** | (2006.01) |
| ***B66B 7/02*** | (2006.01) |

(52) U.S. Cl.

CPC ..... *B66B 9/187* (2013.01); *B66B 7/02* (2013.01); *B66B 11/0005* (2013.01); *E04G 3/28* (2013.01); *E04G 21/3247* (2013.01); *E04G 2003/286* (2013.01)

(58) Field of Classification Search

CPC ..... B66B 9/187; B66B 11/0005; E04G 3/28; E04G 2003/286; E04G 21/3247

USPC ..... 187/239, 240, 241; 425/63, 65

See application file for complete search history.

(56) References Cited

U.S. PATENT DOCUMENTS

| | | | | | |
|---|---|---|---|---|---|
| 365,833 | A | * | 7/1887 | MacDonald | A62C 3/00 169/54 |
| 394,781 | A | * | 12/1888 | Maurer | E04G 5/04 182/113 |
| 1,352,500 | A | * | 9/1920 | Bumgarner | B66B 9/00 187/239 |
| 2,644,545 | A | * | 7/1953 | North | B66B 9/187 187/242 |
| 2,840,187 | A | * | 6/1958 | Bianca | E04H 6/225 187/239 |
| 2,883,002 | A | * | 4/1959 | Moyer | B66B 9/187 182/103 |
| 3,672,471 | A | * | 6/1972 | Badding | A01F 25/163 182/141 |
| 3,763,964 | A | * | 10/1973 | Davis | B66B 9/187 187/239 |

(Continued)

FOREIGN PATENT DOCUMENTS

| | | |
|---|---|---|
| CN | 202194265 U | 4/2012 |
| CN | 103510718 A | 1/2014 |

(Continued)

*Primary Examiner* — Michael Safavi

(74) *Attorney, Agent, or Firm* — Andrew W. Chu; Craft Chu PLLC

(57) ABSTRACT

The hoisting apparatus includes a climbing rail, which is adapted to be suspended on and translated vertically along a construction at a distance from the ground. There is an enclosure supported by the climbing rail. There is also a lifting platform that is housed within the enclosure and is vertically movable relative to the enclosure.

12 Claims, 4 Drawing Sheets

(56) References Cited

U.S. PATENT DOCUMENTS

| | | | | | |
|---|---|---|---|---|---|
| 3,820,632 | A * | 6/1974 | Jines | B66B 9/00 | 187/240 |
| 3,887,038 | A * | 6/1975 | Buschbom | B66B 1/34 | 187/239 |
| 4,865,158 | A * | 9/1989 | Checkly | A01D 87/122 | 187/239 |
| 4,946,006 | A * | 8/1990 | Kume | B66B 9/003 | 182/141 |
| 5,253,734 | A * | 10/1993 | Laurutis | A62B 1/02 | 187/239 |
| 6,079,520 | A * | 6/2000 | Black | B66B 19/00 | 187/239 |
| 7,377,218 | B2 * | 5/2008 | Hyacinthe | A62B 5/00 | 104/127 |
| 2002/0139619 | A1 * | 10/2002 | Qiu | B66B 7/02 | 187/239 |
| 2010/0038518 | A1 | 2/2010 | Schwoerer | | |
| 2012/0048654 | A1 * | 3/2012 | Steward | B66B 9/187 | 187/245 |
| 2015/0107186 | A1 * | 4/2015 | Wilts | B66B 19/002 | 52/741.1 |

FOREIGN PATENT DOCUMENTS

| | | | | |
|---|---|---|---|---|
| DE | 2360634 | * | 6/1974 | E04G 3/28 |
| FR | 2975388 | * | 11/2012 | B66B 9/187 |
| GB | 2529470 | * | 2/2016 | E04G 3/28 |
| JP | 2012206857 A | | 10/2012 | |

* cited by examiner

HOISTING APPARATUS WITH ENCLOSURE AND LIFTING PLATFORM

CROSS-REFERENCE TO RELATED APPLICATIONS

See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present disclosure relates to a hoisting apparatus. In particular, it relates to a hoisting apparatus that may be suspended from a construction. It further relates to a hoisting system comprising the hoisting apparatus.

2. Description of Related Art Including Information Disclosed Under 37 CFR 1.97 and 37 CFR 1.98.

In modern construction, particularly in the construction of high rise buildings it is common to have a central core, which houses lift shafts and stair wells and which provides support to the floors of the construction, wherein the central core and floors are formed by poured concrete. Such structures commonly have no external walls. During construction, it is often necessary to transport equipment to/from recently poured floors. A hoisting apparatus is commonly used for such purposes, which extends vertically on one side of the construction and comprises a lifting platform that moves vertically to carry men and equipment between floors.

Hoisting apparatuses have traditionally been supported on the ground and arranged to be built up in height as the construction rises. This is inefficient/inconvenient for various reasons. Not least, since the use of the hoisting apparatuses is only required at and closely below recently poured floors. There have been proposed arrangements which are initially mounted on the floor and are subsequently suspended on a structure at a distance from the ground. These arrangements, however, maintain several limitations present in the traditional hoisting apparatuses, including providing access to recently poured floors. Furthermore, they introduce risks associated with equipment falling from the construction.

BRIEF SUMMARY OF THE INVENTION

The present invention arose in a bid to provide a further improved hoisting system.

According to the present invention in a first aspect, there is provided a hoisting apparatus comprising: a climbing rail, which is adapted to be suspended on and translated vertically along a construction at a distance from the ground; an enclosure supported by the climbing rail; and a lifting platform that is housed within the enclosure and is vertically movable relative to the enclosure.

According to the present invention in a further aspect, there is provided a hoisting apparatus comprising: a climbing rail, which is adapted to be suspended on and translated vertically along a construction at a distance from the ground; a lifting platform that is vertically movable relative to the climbing rail; and an inner screen, which is arranged to lie between the construction and the lifting platform when the hoisting apparatus is suspended on the construction, the inner screen comprising at least one opening for providing access to the lifting platform from the construction, and an access door for closing the opening.

Further, preferred, features of the hoisting apparatus are defined in the dependent claims.

According to the present invention in a further aspect, there is provided a hoisting system comprising a hoisting apparatus as defined above and a plurality of hoisting apparatus supports, each of the hoisting apparatus supports comprising: a support element fixable to the surface of a floor of the construction, adjacent an edge of the floor, and a climbing shoe at an end of the support element for engaging the climbing rail of the hoisting apparatus.

Further, preferred, features of the hoisting system are defined in the dependent claims.

BRIEF DESCRIPTION OF THE SEVERAL VIEWS OF THE DRAWINGS

Non-limiting embodiments will now be described, by way of example only, with reference to the accompanying drawings.

DETAILED DESCRIPTION OF THE INVENTION

Figure 1:
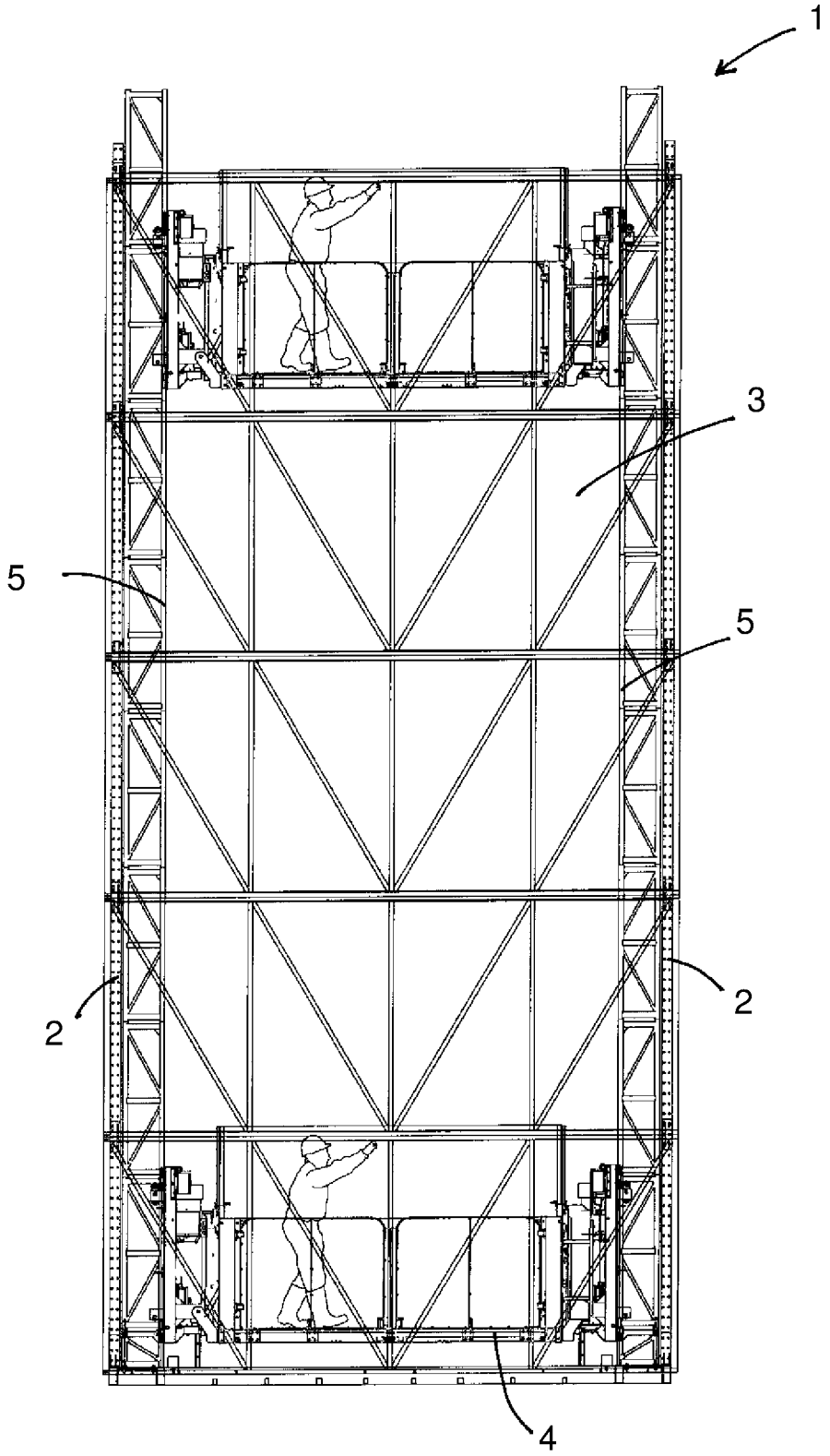
FIG. 1 shows a rear (outer) elevation view of a hoisting apparatus according to an embodiment of the present invention and shows the lifting platform at its extremes of travel.

FIGS. 1 to 4 show a hoisting apparatus 1, which broadly comprises a climbing rail 2, an enclosure 3 and a lifting platform 4. In the present arrangement there are two spaced parallel climbing rails 2 provided. In alternative arrangements there may be additional climbing rails provided. The climbing rails are adapted to be suspended on and translated vertically along a construction 10 at a distance from the ground. The enclosure is supported by the climbing rails (and is thereby suspended and translated along the construction at a distance from the ground). The enclosure is supported only by the climbing rails. The lifting platform is housed within the enclosure and is vertically movable relative to the enclosure (and the climbing rails).

The enclosure comprises an inner screen 6, which is arranged to lie between the construction and the lifting platform when the hoisting apparatus is suspended on the construction. The enclosure, including the inner screen, has a vertical height that spans multiple floors of the construction. The inner screen comprises multiple openings 7 therein, which are vertically spaced from one another. Two or more, and preferably all, of the openings may be brought into vertical alignment with corresponding floors 20 of the construction by vertical translation of the hoisting apparatus along the construction. Doors 8 are provided for closing the openings.

Whilst multiple openings are provided in the present arrangement there could instead be provided a single vertically extending opening with multiple vertically spaced doors for restricting access to the opening at different floor levels of the construction.

The doors need not entirely cover the opening(s) although this is preferable. The doors may substantially cover the opening(s) or gaps may be provided. The doors are configured to at least hinder access to the opening(s) from respective floors of the construction. They act primarily as safety barriers for blocking user access to prevent accidents.

Figure 3:
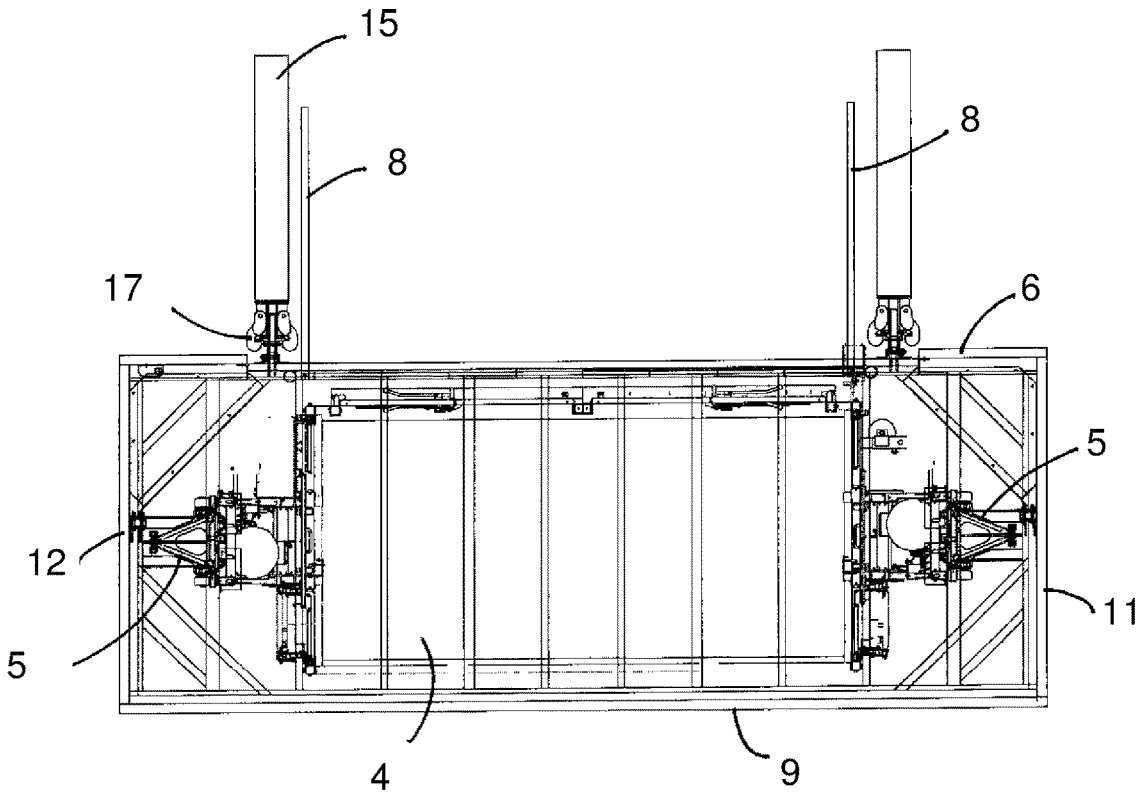
FIG. 3 shows a top plan view of hoisting apparatus of FIG. 1 and shows the open and closed positions and travel of access doors on the inner panel.
Figure 4:
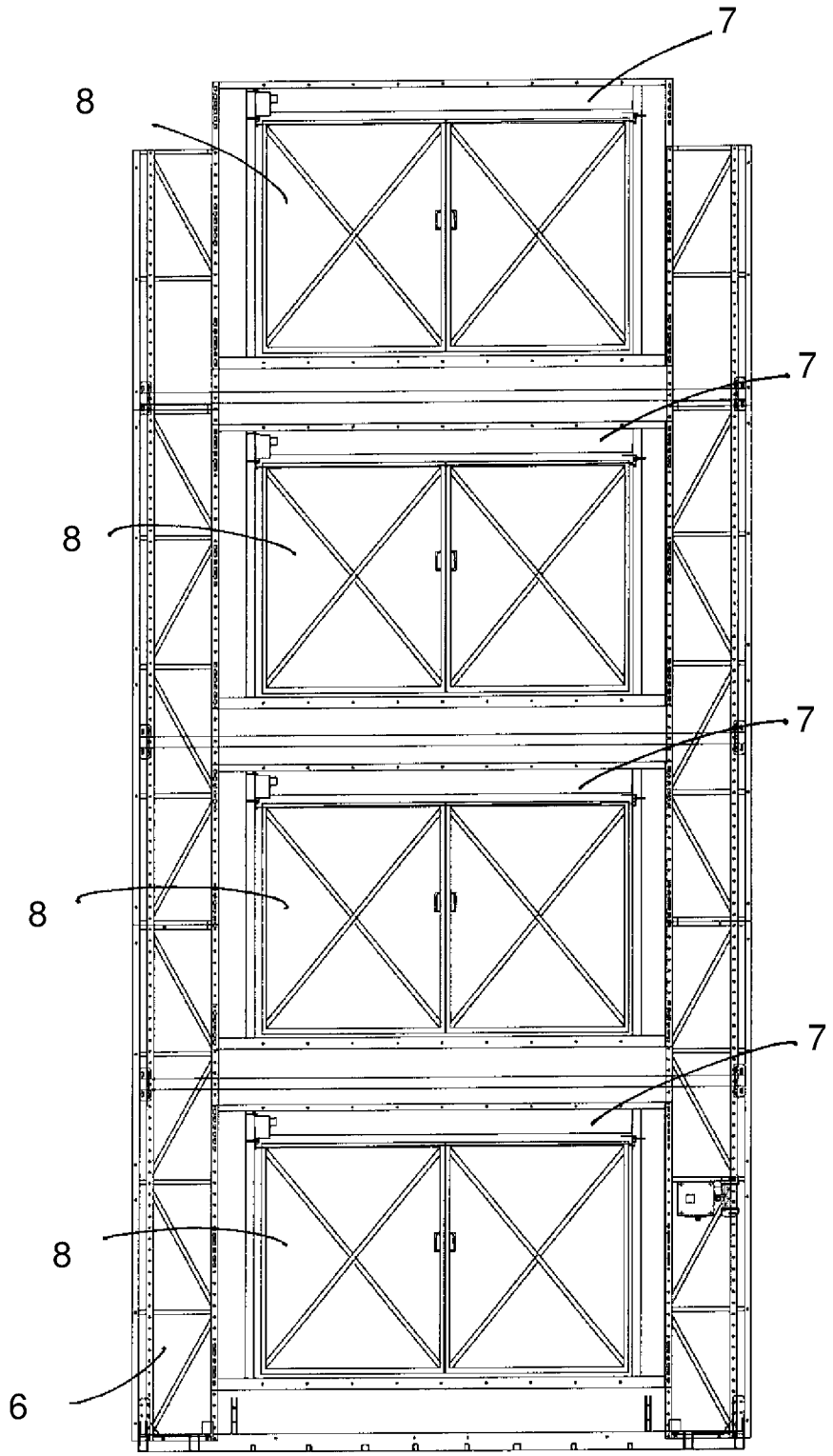
FIG. 4 shows a front (inner) elevation view of the hoisting apparatus of FIG. 1.

The doors may be attached in any suitable manner and may take any suitable form, they are not to be limited. In the present arrangement, as seen in FIGS. 3 and 4, each of the openings is closed by a pair of hinged doors. Irrespective of the form of the doors, suitable locking means will be provided to prevent the opening of each of the doors when the lifting platform is not stationary and at the appropriate level.

By virtue of the provision of the inner screen with the access opening(s) closed by the doors, there is no need to install safety gates on the floors of the construction themselves, as is the case in prior art arrangements. This is particularly beneficial when providing access to freshly poured floors where access to formwork or similar may be required but where it is not yet possible to install a safety gate, and where access to/from the hoisting apparatus would otherwise be prevented for health and safety reasons. Moreover, the inner screen 6 closes off a portion of the perimeter of the construction on the floors 20 that it spans, in the same manner as a climbing screen. This is particularly beneficial when the hoisting apparatus is used in conjunction with climbing screens, as discussed further below, wherein the perimeter of those floors may be closed off by the combination of the climbing screens and the hoisting apparatus.

The enclosure preferably comprises a box having one or more closed faces. Preferably at least the bottom face and four side faces of the box, as defined when the hoisting apparatus is suspended on the construction, are closed as shown in the present arrangement. Most preferably the faces are each closed by a single mesh panel or multiple mesh panels. The panels are preferably rigid to aid in increasing the structural rigidity of the enclosure but may be also flexible. Whilst the panels need not be mesh, they are preferably formed with perforations of some form to allow a degree of airflow therethrough, since the panels will be subject to wind forces when the hoisting apparatus is suspended on the construction.

The inner face 6 comprises a front closed side face of the box. The inner face is preferably substantially planar as shown. In addition to the front closed side face there is provided an opposed and parallel outer closed side face 9 of the box and a pair of opposed and parallel closed side faces 11, 12 that join the inner and outer faces to one another. A closed bottom face 13 is further provided. These additional closed faces are all preferably substantially planar. In the present arrangement, the top of the box is open. It could, however, comprise a further closed face.

With the four side faces and the bottom face closed, it can be ensured that tools, materials or equipment do not fall from the suspended hoisting apparatus. The arrangement is such that the panels forming the closed faces abut one another or are closely spaced from one another to avoid gaps through which tools, materials or equipment may fall.

Whatever the structure of the enclosure, it preferably comprises a rigid self-supporting structure. A suitable framework will generally be provided to provide structural rigidity to the box, which structure can take any suitable form as will be readily appreciated by those skilled in the art. The climbing rails may form part of this structure or may be fixed to this structure.

Housed within the enclosure is a hoist, which comprises a pair of spaced parallel vertically extending hoist masts 5 and a lifting platform. The lifting platform is supported by the hoist masts and travels vertically along the hoist masts. Travel of the lifting platform is effected by an electric motor. The hoist may be of any conventional form and is not limited to the arrangement shown. The hoist masts may be integral to the structure of the enclosure and may add to the structural integrity thereof.

In one particular alternative arrangement (not shown), the hoisting apparatus may be reconfigured such that the hoist masts are omitted and the lifting platform is instead supported by the guide rails directly and travels vertically along the guide rails.

Figure 2:
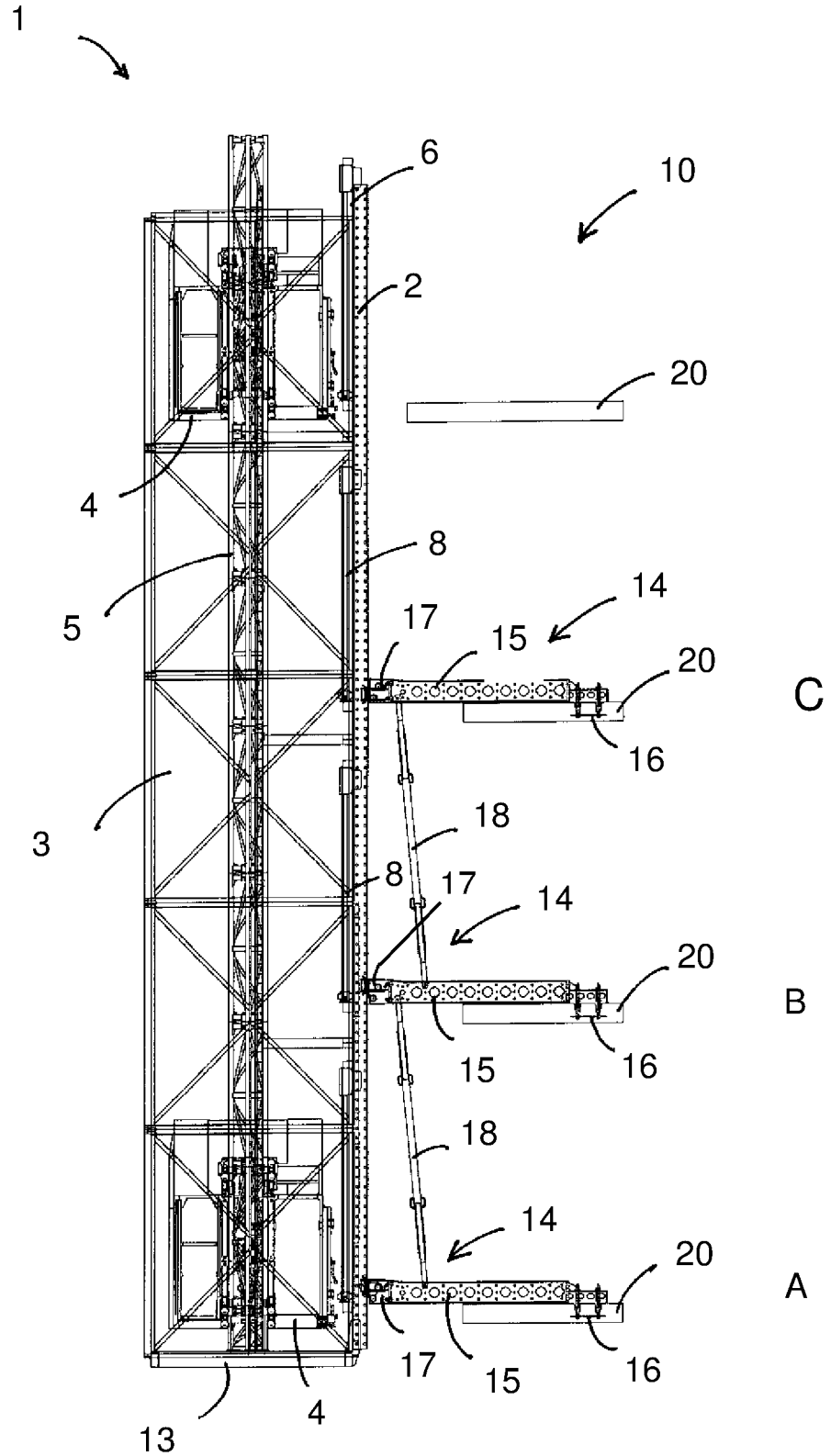
FIG. 2 shows a side elevation view of the hoisting apparatus of FIG. 1 showing the suspension of the hoisting apparatus on a construction.

With particular reference to FIG. 2, there is shown a hoisting system, which comprises the hoisting apparatus and a plurality of hoisting apparatus supports 14. Each of the hoisting apparatus supports comprises a support element 15 fixable to the surface of a floor of the construction. In the present arrangement anchor bolts 16 are cast into the floors of the construction at appropriate positions, adjacent the edges of the floors. The support elements are fixed to the anchor bolts using suitable nuts. Alternative attachment means could of course be used. The support elements extend out beyond the edges of the floors 20. Each of the support elements is provided with a climbing shoe 17 at its end for engaging a respective one of the climbing rails of the hoisting apparatus. The climbing shoes may be integrally formed with the support elements or may comprise separate elements fixed thereto. The hoisting apparatus supports (and the climbing rails to be engaged thereby) may take any conventional form known in the construction art. When the hoisting apparatus is suspended from the construction it is supported by the hoisting apparatus supports only.

In the present arrangement, the hoisting apparatus is supported by supports provided on three adjacent floors 20 (A, B, C). That is, each of the climbing rails is engaged by three supports provided on adjacent floors. In alternative arrangements there may be supports provided on more or less floors. In any arrangement, however, it is preferable that the hoisting apparatus extends to at least the floor above the highest floor provided with a support such that access to such floor may be obtained by the lifting platform.

In the present arrangement tie elements 18, which may comprise bars, cables or otherwise are provided, which extend between adjacent supports at an oblique angle. Such ties are useful to spread loads.

Where there is formwork in place on any of the floors spanned by the hoisting apparatus, the formwork will generally substantially extend between the edges of those floors and the inner face 6 of the hoisting apparatus. Otherwise, the formwork may support a suitable platform. On any of the floors that are provided with the supports 14 there may be provided a platform that substantially extends between the edge of the floor and the inner face 6 of the hoisting apparatus. Such platform may be supported by the supports 14 or may be otherwise supported in any conventional manner. The platform may take any conventional form that allows for a worker and/or equipment to be supported thereby beyond the edge of the floor of the construction. The platform may support a work platform comprising wooden sheeting or otherwise.

The hoisting system may further comprise one or more climbing screens (not shown), each of which comprises climbing rails and a safety screen. The climbing rails (in the same manner as the climbing rails of the hoisting apparatus) are adapted to be mountable on and translatable along the construction. The safety screen is supported by the climbing rails. The climbing rails are engaged by climbing screen supports, which may be identical to the hoisting apparatus supports 14, as described above.

There may be support elements and/or platforms extending between the climbing rails and safety screen. The climbing screens may be of any conventional structure.

The climbing screens may each have the same vertical height as the hoisting apparatus. There may be a climbing screen closely adjacent to each of the vertically extending side edges of the inner screen 6, such that the climbing screens and the hoisting apparatus together close off the perimeter of all of the floors spanned thereby, wholly or partially. The climbing screens and the hoisting apparatus may be moved up the building such that they span the same floors during periods of construction.

Whilst the hoisting apparatus could be lifted by crane with the supports guiding the vertical travel, it is preferred that the hoisting apparatus is self-climbing. To effect hydraulic lifting, suitable hydraulic lifting means will be provided in the conventional manner, which will be adapted to engage the hoisting apparatus and lift the climbing rail relative to the hoisting apparatus supports.

Numerous modifications will be possible to the hoisting apparatus as described herein, within the scope of the claims that follow.

I claim:

1. A hoisting apparatus, comprising:

a climbing rail, suspended on and translated vertically along a construction at a distance from ground;

an enclosure supported by said climbing rail;

a lifting platform housed within said enclosure and being vertically movable relative to the enclosure; and a hoist mast that extends within the enclosure and supports the lifting platform.

2. The hoisting apparatus, as claimed in claim 1, wherein the enclosure comprises a box having one or more closed faces.

3. The hoisting apparatus, as claimed in claim 2, wherein at least the bottom face and four side faces of the box, as defined when the hoisting apparatus is suspended on the construction, are closed.

4. The hoisting apparatus, as claimed in claim 3, wherein the closed faces of the box each comprise one or more mesh or perforated panels.

5. The hoisting apparatus, as claimed in claim 1, wherein the enclosure comprises a rigid self-supporting structure.

6. The hoisting apparatus as claimed in claim 1, wherein the enclosure has a vertical height that spans multiple floors of the construction when the hoisting apparatus is suspended on the construction.

7. A hoisting apparatus, comprising:

a climbing rail, suspended on and translated vertically along a construction at a distance from ground;

an enclosure supported by said climbing rail; and a lifting platform housed within said enclosure and being vertically movable relative to the enclosure, wherein the enclosure comprises a box having one or more closed faces, and wherein the box comprises an inner side face, which is arranged to lie between the construction and the lifting platform when the hoisting apparatus is suspended on the construction, the inner side face comprising at least one opening for providing access to the enclosure from the construction, and an access door for covering the opening.

8. The hoisting apparatus, as claimed in claim 7, wherein the inner side face has a vertical height that spans multiple floors of the construction and comprises multiple openings provided with access doors, which openings are vertically spaced from one another, such that two or more of the openings may be brought into vertical alignment with corresponding floors of the construction by vertical translation of the hoisting apparatus along the construction.

9. The hoisting apparatus, as claimed in claim 7, wherein the inner side face has a vertical height that spans multiple floors of the construction and comprises a single vertically extending opening provided with multiple access doors, which access doors are vertically spaced from one another, such that two or more of the access doors may be brought into vertical alignment with corresponding floors of the construction by vertical translation of the hoisting apparatus along the construction.

10. A hoisting system, comprising:

a hoisting apparatus being comprised of:

a climbing rail, suspended on and translated vertically along a construction at a distance from ground;

an enclosure supported by said climbing rail; and a lifting platform housed within said enclosure and being vertically movable relative to the enclosure; and a plurality of hoisting apparatus supports, each of the hoisting apparatus supports comprising:

a support element fixable to the surface of a floor of the construction, adjacent an edge of the floor, and a climbing shoe at an end of the support element for engaging the climbing rail of the hoisting apparatus.

11. The hoisting system, as claimed in claim 10, further comprising: hydraulic lifting means for engaging the hoisting apparatus and lifting the climbing rail relative to the hoisting apparatus supports.

12. The hoisting system as claimed in claim 10, further comprising: a plurality of climbing screens, wherein one of the climbing screens is provided closely adjacent to each of the vertically extending side edges of the inner side face, wherein the enclosure comprises a box having one or more closed faces, and wherein the box comprises an inner side face, which is arranged to lie between the construction and the lifting platform when the hoisting apparatus is suspended on the construction, the inner side face comprising at least one opening for providing access to the enclosure from the construction, and an access door for covering the opening.

* * * * *